US007070894B2

(12) United States Patent
Bender et al.

(10) Patent No.: US 7,070,894 B2
(45) Date of Patent: Jul. 4, 2006

(54) PHOTOCONDUCTIVE IMAGING MEMBERS

(75) Inventors: Timothy P. Bender, Port Credit (CA); John F. Graham, Oakville (CA); Ah-Mee Hor, Mississauga (CA); Johann Junginger, Toronto (CA)

(73) Assignee: Xerox Corporation, Stamford, CT (US)

( * ) Notice: Subject to any disclaimer, the term of this patent is extended or adjusted under 35 U.S.C. 154(b) by 191 days.

(21) Appl. No.: 10/774,713

(22) Filed: Feb. 9, 2004

(65) Prior Publication Data

US 2005/0175913 A1 Aug. 11, 2005

(51) Int. Cl.
*G03G 5/147* (2006.01)

(52) U.S. Cl. ..... 430/64; 430/58.25; 430/58.05

(58) Field of Classification Search ..... 430/64, 430/58.25, 58.05
See application file for complete search history.

(56) References Cited

U.S. PATENT DOCUMENTS

| | | | | |
|---|---|---|---|---|
| 4,265,990 | A | 5/1981 | Stolka et al. | 430/59 |
| 4,921,769 | A | 5/1990 | Yuh et al. | 430/64 |
| 5,482,811 | A | 1/1996 | Keoshkerian et al. | 430/135 |
| 5,660,961 | A * | 8/1997 | Yu | 430/65 |
| 6,277,535 | B1 * | 8/2001 | Liu et al. | 430/64 |
| 6,444,386 | B1 | 9/2002 | Liu et al. | 430/64 |

OTHER PUBLICATIONS

Belknap, Nancy L. et al., U.S. Appl. No. 10/408,201, filed Apr. 4, 2003 on Photoconductive Imaging Members.
Wu, Jin et al., U.S. Appl. No. 10/369,816, filed Feb. 19, 2003 on Photoconductive Imaging Members.
Wu, Jin et al., U.S. Appl. No. 10/370,186, filed Feb. 19, 2003 on Photoconductive Imaging Members.

* cited by examiner

*Primary Examiner*—John L Goodrow
(74) *Attorney, Agent, or Firm*—E. O. Palazzo

(57) ABSTRACT

A photoconductive imaging member comprised of an optional supporting substrate, a hole blocking layer thereover, a photogenerating layer, and a charge transport layer, and wherein the hole blocking layer is comprised of at least one copolymer of an aminoalkyltrialkoxysilane and a silane.

28 Claims, No Drawings

PHOTOCONDUCTIVE IMAGING MEMBERS

CROSS-REFERENCE TO RELATED APPLICATIONS

Illustrated in U.S. Pat. No. 6,858,363, entitled Imaging Members, the disclosure of which is totally incorporated herein by reference, is a photoconductive imaging member comprised of a supporting substrate, a hole blocking layer thereover, a photogenerating layer, and a charge transport layer, and wherein the hole blocking layer is comprised of a metallic component and an electron transport component.

Illustrated in U.S. Ser. No. 10/408,204, U.S. Publication 20040197685, entitled Imaging Members, the disclosure of which is totally incorporated herein by reference, is a photoconductive imaging member comprised of a supporting substrate, and thereover a single layer comprised of a mixture of a photogenerator component, charge transport components, and a certain electron transport component, and a certain polymer binder.

Illustrated in copending application U.S. Ser. No. 10/144,147, U.S. Publication 20030211413, entitled Imaging Members, filed May 10, 2002 by Liang-Bih et al., the disclosure of which is totally incorporated herein by reference, is a photoconductive imaging member comprised of a supporting substrate, and thereover a single layer comprised of a mixture of a photogenerator component, a charge transport component, an electron transport component, and a polymer binder, and wherein the photogenerating component is a metal free phthalocyanine.

There is illustrated in U.S. Pat. No. 6,913,813, entitled Photoconductive Imaging Members, filed Feb. 19, 2003, the disclosure of which is totally incorporated herein by reference, a photoconductive imaging member comprised of a hole blocking layer, a photogenerating layer, and a charge transport layer, and wherein the hole blocking layer is comprised of a metal oxide, and a mixture of a phenolic compound and a phenolic resin wherein the phenolic compound contains at least two phenolic groups.

There is illustrated in copending U.S. Ser. No. 10/370,186, U.S. Publication 20040161683, entitled Photoconductive Imaging Members, filed Feb. 19, 2003, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,875,548, entitled Photoconductive Imaging Members, filed Feb. 19, 2003, the disclosure of which is totally incorporated herein by reference, a photoconductive imaging member comprised of an optional supporting substrate, a photogenerating layer, and a charge transport layer, and wherein said charge transport layer is comprised of a charge transport component and a polysiloxane.

There is illustrated in U.S. Pat. No. 6,824,940, entitled Photoconductive Imaging Members, filed Feb. 19, 2003, the disclosure of which is totally incorporated herein by reference, a photoconductive imaging member containing a hole blocking layer, a photogenerating layer, a charge transport layer, and thereover an overcoat layer comprised of a polymer with a low dielectric constant and charge transport molecules.

The appropriate components and processes of the above copending applications may be selected for the present invention in embodiments thereof.

BACKGROUND

This invention in embodiments is generally directed to imaging members, and more specifically, the present invention in embodiments is directed to multilayered photoconductive imaging members with a hole blocking layer comprised, for example, of polymers, particularly copolymers of an aminoalkyltrialkoxysilane, such as 3-aminopropyltrialkoxy silane (g-APS) and an aminodialkyldialkoxysilane, such as 3-aminopropyl methyldiethoxysilane (2-APS), copolymers of an aminoalkyltrialkoxy silane and a dialkoxydialkylsilane, such as diethoxydimethylsilane or copolymers of an aminoalkyltrialkoxysilane, and a silane, such as a monoalkoxy silane, a dialkoxy silane, a tetraalkoxy silane, and the like. The hole blocking layer is in embodiments in contact with the supporting substrate and is preferably situated between the supporting substrate and the photogenerating layer comprised of photogenerating pigments, such as those illustrated in U.S. Pat. No. 5,482,811, the disclosure of which is totally incorporated herein by reference, especially Type V hydroxygallium phthalocyanine.

It is believed, although not being desired to be limited by theory, that the chemistry of amino-alkyl substituted trialkoxysilanes is dissimilar in both rate and scope from that of other trialkoxysilanes primarily because of the ability of the amino group to function as an internal catalyst in the reactions of these materials. A specific example of an amino-alkyl substituted trialkoxysilane disclosed herein is 3-aminopropyltriethoxysilane (γ-APS, gamma-aminopropyltriethoxysilane) which can undergo sol-gel type chemistry, and thus can be assumed to hydrolyze and condense in the presence of water. Conceptually, this reaction can be considered as a series of equilibrium between partially hydrolysis and partially condensed species. Conditions present during the hydrolysis and condensation, and the nature of the reactant γ-APS may effect the final distribution of species present and hence an indication of the predominant reaction pathway and pertinent equilibria. Since g-APS is a trialkoxy silane, it is capable of forming not only linear polysiloxanes, but polysilsesquioxanes and polyoctahedralsilsesquioxanes (POSS).

The imaging members of the present invention in embodiments exhibit excellent cyclic/environmental stability, and substantially no adverse changes in their performance over extended time periods; minimal amounts of charge deficient spots (CDSs), for example such a member may contain as low as 10 CDSs whereas a member containing a blocking layer containing only 3-aminopropyltrialkoxy silane may contain over 100 CDSs. The aforementioned photoresponsive, or photoconductive imaging members can be negatively charged when the photogenerating layer is situated between the hole transport layer and the hole blocking layer deposited on the substrate.

Processes of imaging, especially xerographic imaging and printing, including digital, are also encompassed by the present invention. More specifically, the layered photoconductive imaging members of the present invention can be selected for a number of different known imaging and printing processes including, for example, electrophotographic imaging processes, especially xerographic imaging and printing processes wherein charged latent images are rendered visible with toner compositions of an appropriate charge polarity. The imaging members as indicated herein are in embodiments sensitive in the wavelength region of, for example, from about 500 to about 900 nanometers, and in particular from about 650 to about 850 nanometers, thus diode lasers can be selected as the light source. Moreover, the imaging members of this invention are useful in color xerographic applications, particularly high-speed color copying and printing processes.

REFERENCES

Illustrated in Loy and Sanchez is the chemistry of aminopropyltrialkoxysilanes under neutral and acidic aqueous conditions, see Sanchez, A.; Loy, D. A.; *Polym. Prepr.,* 2001, 42(1), 182–183, which indicates that it is possible to obtain highly condensed species from γ-APS and related materials under aqueous conditions, and the species formed are present in a dynamic equilibrium state. Assignments of the resonances in the $^{29}$Si spectrum can be made based on the detailed Si NMR studies of other trialkoxysilanes, see Myers, S. A.; Assink, R. A.; Loy, D. A.; Shea, K. J.; *J. Chem. Soc.*, Perkin Trans. 2, 2000, 545–549; Alam, T. M.; Assink, R. A.; Loy, D. A.; *Chem. Mater.,* 1996, 8, 2366–2374, and Loy, D. A.; Baugher, B. A.; Baugher, C. R.; Schneider, D. A.; Rahimian, K.; *Chem. Mater.,* 2000, 12, 3624–3632.

An interesting form of γ-APS is the POSS form, see, for example, Gravel, M. C.; Laine, R. M.; *Polym. Prepr.,* 1997, 38(2), 155–156; Feher, F. J.; Wyndham, K. D.; *Chem. Comm.,* 1998, 323–324; and Feher, F. J.; Newman, D. A.; Walzer, J. F.; *J. Am. Chem. Soc.,* 1989, 111, 1741–1748.

In a photoreceptor, many types of microdefects can be a source of xerographic image degradation. These microdefects can be comprised of occlusions of particles, bubbles in the coating layers, microscopic areas in a photoreceptor without a charge generator layer, coating thickness nonuniformities, dark decay nonuniformities, light sensitivity nonuniformities, and/or charge deficient spots (CDSs). Charge deficient spots, or CDSs are localized areas of discharge without activation by light. They can cause two types of image defects, depending on the development method utilized. Charge deficient spots usually can be detected only electrically or by xerographic development. In discharged area development, the photoreceptor is negatively charged. An electrostatic latent image, as a charge distribution, is formed on the photoreceptor by selectively discharging certain areas. Toner attracted to discharged areas develops this latent image. Laser printers usually function on this principle. When charge deficient spots are present on the photoreceptor, examination of the final image after toner transfer form the photoreceptor to a receiving member such as paper reveals dark spots on a white background due to the absence of negative charge in the charge deficient spots. One technique for detecting charge deficient spots in photoreceptors is to cycle the photoreceptor in the specific type of copier, duplicator and printer machine for which the photoreceptor was fabricated. Generally, actual machine testing provides one accurate method for detecting charge deficient spots in a photoreceptor from a given batch. However, machine testing for detecting charge deficient spots is a very laborious and time consuming process which requires involving hand feeding of sheets by test personnel along with constant monitoring of the final quality of every sheet. Moreover, accuracy of the test results depends a great deal upon interpretations and behavior of the personnel that are feeding and evaluating the sheets. Because of machine complexity and variations from machine to machine, the data from a test in a single machine is not usually sufficient. Thus, tests are normally conducted in three or more machines.

An alternative technique for detecting CDSs has recently been developed, reference U.S. Pat. No. 6,008,653 and U.S. Pat. No. 6,119,536, the disclosures of which ae totally incorporated herein by reference. This is a non-contact technique capable of detecting microscopic variations in the surface potential of charged dielectric films. The technique is based on measuring the charge induced on a small capacitive probe held at a constant distance from a charged sample surface. Distance control is achieved by aerodynamic floating, which is an inexpensive and simple passive feedback system capable of maintaining a constant probe-sample separation despite minor variations in sample morphology. This technique can be used to detect the presence of microscopic electrostatic defects in organic photoreceptors, such as charge deficient spots (CDSs).

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

In U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Both of the aforementioned patents disclose an aryl amine component, such as N,N'-diphenyl-N,N'-bis(3-methyl phenyl)-1,1'-biphenyl-4,4'-diamine dispersed in a polycarbonate binder, as a hole transport layer. The above components, such as the photogenerating compounds, and the aryl amine charge transport can be selected for the imaging members of the present invention in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. No. 6,444,386, the disclosure of which is totally incorporated herein by reference, is a photoconductive imaging member comprised of an optional supporting substrate, a hole blocking layer thereover, a photogenerating layer, and a charge transport layer, and wherein the hole blocking layer is generated from crosslinking an organosilane (I) in the presence of a hydroxy-functionalized polymer (II)

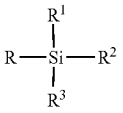

(I)

-continued (II)

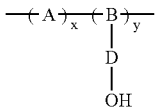

wherein R is alkyl or aryl; $R^1$, $R^2$, and $R^3$ are independently selected from the group consisting of alkoxy, aryloxy, acyloxy, halide, cyano, and amino; A and B are, respectively, divalent and trivalent repeating units of polymer (II); D is a divalent linkage; x and y represent the mole fractions of the repeating units of A and B, respectively, and wherein x is from about 0 to about 0.99, and y is from about 0.01 to about 1, and wherein the sum of x+y is equal to about 1.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water (I)

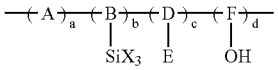

(II)

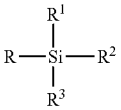

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

A number of photoconductive members and components thereof are illustrated in U.S. Pat. Nos. 4,988,597; 5,063,128; 5,063,125; 5,244,762; 5,612,157; 6,218,062; 6,200,716 and 6,261,729, the disclosures of which are totally incorporated herein by reference.

SUMMARY

It is a feature of the present invention to provide imaging members with many of the advantages illustrated herein, such as the elimination/minimization of CDS's levels arising from the dark injection of charge carriers; a thick hole blocking layer that prevents, or minimizes dark injection, and wherein the resulting photoconducting members possess, for example, excellent photoinduced discharge characteristics, cyclic and environmental stability and acceptable charge deficient spot.

Another feature of the present invention relates to the provision of layered photoresponsive imaging members, which are responsive to near infrared radiation of from about 700 to about 900 nanometers.

It is yet another feature of the present invention that there are provided layered photoresponsive imaging members with a sensitivity to visible light, and which members possess acceptable coating characteristics, and wherein the charge transport molecules do not diffuse, or there is minimum diffusion thereof into the photogenerating layer.

Aspects of the present invention relate to a photoconductive imaging member comprised of an optional supporting substrate, a hole blocking layer thereover, a photogenerating layer, and a charge transport layer, and wherein the hole blocking layer is comprised of at least one copolymer of an aminoalkyltrialkoxysilane and a silane; a photoconductive imaging member comprised of a supporting substrate, a hole blocking layer thereover, a photogenerating layer, and a charge transport layer, and wherein the hole blocking layer is comprised of at least one copolymer of an aminoalkyltrialkoxysilane, and an aminodialkyldialkoxysilane; a photoconductive imaging member comprised of an optional supporting substrate, a hole blocking layer thereover, a photogenerating layer, and a charge transport layer, and wherein the hole blocking layer is comprised of a copolymer of an aminoalkyltrialkoxysilane, and a dialkoxydialkylsilane; a photoconductive imaging member comprised of an optional supporting substrate, a hole blocking layer thereover, a photogenerating layer, and a charge transport layer, and wherein the hole blocking layer is comprised of at least one copolymer of an aminoalkyltrialkoxysilane and a silane, and wherein the copolymer is of the formula

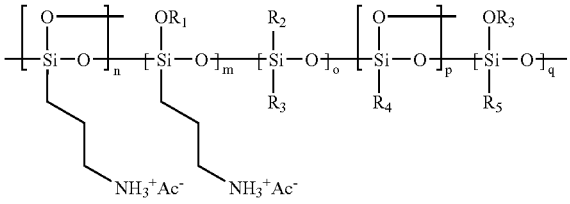

wherein n, m, op and q represent the number or mole percent of each group, and each R is a suitable substituent such as alkyl, aryl, and the like; an imaging member with a hole blocking layer of

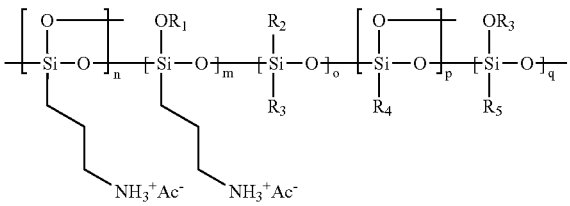

wherein n, m, o, p and q represent the number or mole percent of each group, and each R is a suitable substituent such as alkyl, aryl, and the like; a photoconductive imaging member comprised of a supporting substrate, a hole blocking layer thereover, a photogenerating layer, and a charge transport layer, and wherein the hole blocking layer is comprised of a copolymer or copolymers of an aminoalkyltrialkoxysilane, and a silane; a photoconductive imaging member comprised of a supporting substrate, a hole blocking layer thereover, a photogenerating layer, and a charge transport layer, and wherein the hole blocking layer is comprised of copolymers of an aminoalkyltrialkoxysilane, and a silane; a photoconductive imaging member comprised of a supporting substrate, a hole blocking layer thereover, a photogenerating layer, and a charge transport layer, and wherein the hole blocking layer is comprised of copolymers, an aminoalkyltrialkoxysilane, and a dialkoxydialkylsilane; a photoconductive imaging member comprised of a supporting substrate, a hole blocking layer thereover, a photogenerating layer and a charge transport layer, and wherein the hole blocking layer is as illustrated herein; a photoconductive device further containing an electron transport of, for example, N,N'-bis(1,2-dimethylpropyl)-1,4,5,8-naphthalene tetracarboxylic acid; bis(2-heptylimido)perinone; BCFM, butoxy carbonyl fluorenylidene malononitrile; benzophenone bisimide; or a substituted carboxybenzylnaphthaquinone; a photoconductive imaging member wherein the hole blocking layer contains a copolymer of 3-aminopropyltrialkoxysilane, (g-APS) and 3-aminopropylmethyl diethoxysilane (2-APS) or a copolymer of 3-aminopropyl trialkoxysilane (g-APS) and dimethyldialkoxysilane; a photoconductive imaging member wherein the hole blocking layer is of a thickness of about 10 angstroms to about 12 microns, or is of a thickness of about 100 angstroms to about 5 microns; a photoconductive imaging member comprised in sequence of a supporting substrate, a hole blocking layer, an adhesive layer, a photogenerating layer and a charge transport layer; a photoconductive imaging member wherein the adhesive layer is comprised of a polyester with, for example, an $M_w$ of about 50,000 to about 90,000, and an $M_n$ of from about 25,000 to about 45,000; a photoconductive imaging member wherein the supporting substrate is comprised of a conductive metal substrate; a photoconductive imaging member wherein the conductive substrate is aluminum, aluminized polyethylene terephthalate or titanized polyethylene; a photoconductive imaging member wherein the photogenerator layer is of a thickness of from about 0.05 to about 12 microns; a photoconductive imaging member wherein the charge, such as hole transport layer, is of a thickness of from about 10 to about 55 microns; a photoconductive imaging member wherein the photogenerating layer is comprised of photogenerating pigments in an amount of from about 10 percent by weight to about 90 percent by weight dispersed in a resinous binder; a photoconductive imaging member containing in the photogenerating layer a resinous binder selected from the group consisting of polyesters, polyvinyl butyrals, polycarbonates, polystyrene-b-polyvinyl pyridine, and polyvinyl formals; a photoconductive imaging member wherein the charge transport layers comprise known hole transport molecules; a photoconductive imaging wherein the charge transport comprises aryl amines of the formula

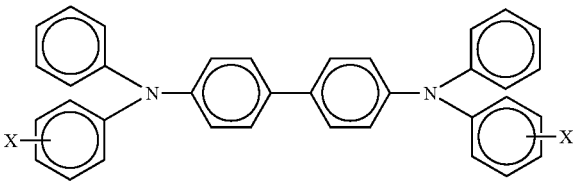

wherein X is alkyl or halo, and wherein the aryl amine is dispersed in a resinous binder; a photoconductive imaging member wherein for the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member further including an adhesive layer of a polyester with an $M_w$ of about 75,000, and an $M_n$ of about 40,000; a photoconductive imaging member wherein the photogenerating layer is comprised of metal phthalocyanines, metal free phthalocyanines, perylenes, hydroxygallium phthalocyanines, chlorogallium phthalocyanines, titanyl phthalocyanines, vanadyl phthalocyanines, selenium, selenium alloys, trigonal selenium, and the like; a photoconductive imaging member wherein the photogenerating layer is comprised of titanyl phthalocyanines, perylenes, or hydroxygallium phthalocyanines; a photoconductive imaging member wherein the photogenerating layer is comprised of Type V hydroxygallium phthalocyanine; and a method of imaging which comprises generating an electrostatic latent image on the imaging member illustrated herein, developing the latent image, and transferring the developed electrostatic image to a suitable substrate.

The imaging members of the present invention can in embodiments contain known electron transport layers illustrated in the copending applications referred to herein, and more specifically, an electron transport component selected, for example, from the group consisting of N,N'-bis(1,2-dimethylpropyl)-1,4,5,8-naphthalenetetracarboxylic diimide represented by the following formula

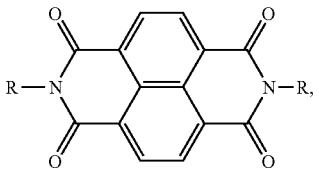

1,1'-dioxo-2-(4-methylphenyl)-6-phenyl-4-(dicyanomethylidene)thiopyran represented by the following formula

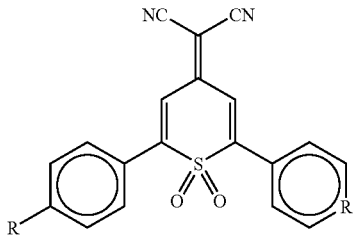

wherein R and R are independently selected from the group consisting of hydrogen, alkyl with, for example, 1 to about 4 carbon atoms, alkoxy with, for example, 1 to about 4 carbon atoms, and halogen; aquinone selected, for example, from the group consisting of carboxybenzylnaphthaquinone represented by the following formula

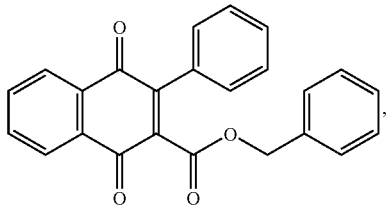

tetra(t-butyl)diphenolquinone represented by the following formula

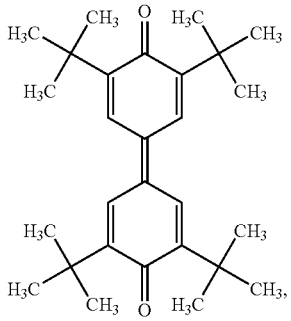

mixtures thereof, and the like; the butoxy derivative of carboxyfluorenone malononitrile; the 2-ethylhexanol of carboxyfluorenone malononitrile; the 2-heptyl derivative of N,N'-bis(1,2-diethylpropyl)-1,4,5,8-naphthalenetetracarboxylic diimide; and the sec-isobutyl and n-butyl derivatives of 1,1-(N,N'-bisalkyl-bis-4-phthalimido)-2,2-biscyano-ethylene.

Specific, and in embodiments preferred, electron transport components are, for example, carboxyfluorenone malononitrile (CFM) derivatives represented by

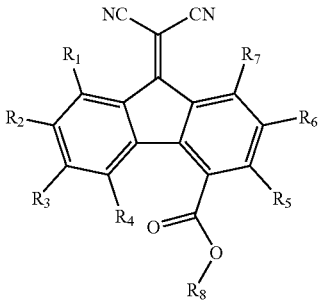

wherein each R is independently selected from the group consisting of hydrogen, alkyl having 1 to about 40 carbon atoms (for example is intended throughout with respect to the number of carbon atoms), alkoxy having 1 to about 40 carbon atoms, phenyl, substituted phenyl, higher aromatic, such as naphthalene and anthracene, alkylphenyl having about 6 to about 40 carbons, alkoxyphenyl having about 6 to about 40 carbons, aryl having about 6 to about 30 carbons, substituted aryl having about 6 to about 30 carbons and halogen; or a nitrated fluorenone derivative represented by

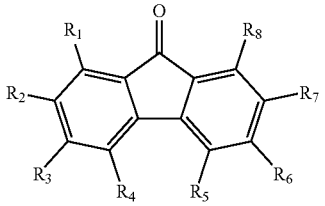

wherein each R is independently selected from the group consisting of hydrogen, alkyl, alkoxy, aryl, such as phenyl, substituted phenyl, higher aromatics, such as naphthalene and anthracene, alkylphenyl, alkoxyphenyl, carbons, substituted aryl and halogen, and wherein at least two R groups are nitro; N,N'-bis(dialkyl)-1,4,5,8-naphthalenetetracarboxylic diimide derivatives or N,N'-bis(diaryl)-1,4,5,8-naphthalenetetracarboxylic diimide derivatives represented by the general formula/structure

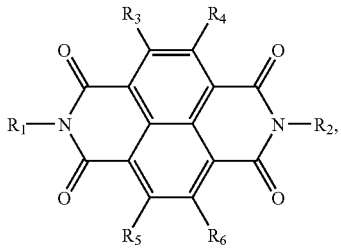

wherein $R_1$ is, for example, substituted or unsubstituted alkyl, branched alkyl, cycloalkyl, alkoxy or aryl, such as phenyl, naphthyl, or a higher polycyclic aromatic, such as anthracene; $R_2$ is alkyl, branched alkyl, cycloalkyl, or aryl, such as phenyl, naphthyl, or a higher polycyclic aromatic, such as anthracene, or wherein $R_2$ is the same as $R_1$; $R_1$ and $R_2$ can independently possess from 1 to about 50 carbons, and more specifically, from 1 to about 12 carbons. $R_3$, $R_4$, $R_5$ and $R_6$ are alkyl, branched alkyl, cycloalkyl, alkoxy or aryl, such as phenyl, naphthyl, or a higher polycyclic aromatic, such as anthracene or halogen and the like. $R_3$, $R_4$, $R_5$ and $R_6$ can be the same or different; a 1,1'-dioxo-2-(aryl)-6-phenyl-4-(dicyanomethylidene)thiopyran

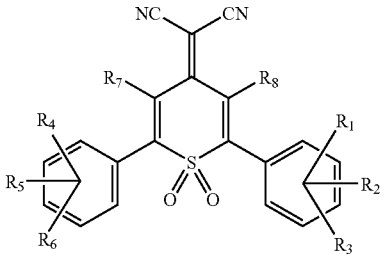

wherein each R is, for example, independently selected from the group consisting of hydrogen, alkyl with 1 to about 40 carbon atoms, alkoxy with 1 to about 40 carbon atoms, phenyl, substituted phenyl, higher aromatics, such as naphthalene and anthracene, alkylphenyl with about 6 to about 40 carbons, alkoxyphenyl with about 6 to about 40 carbons, aryl with about 6 to about 30 carbons, substituted aryl with about 6 to about 30 carbons and halogen; a carboxybenzyl naphthaquinone represented by the following

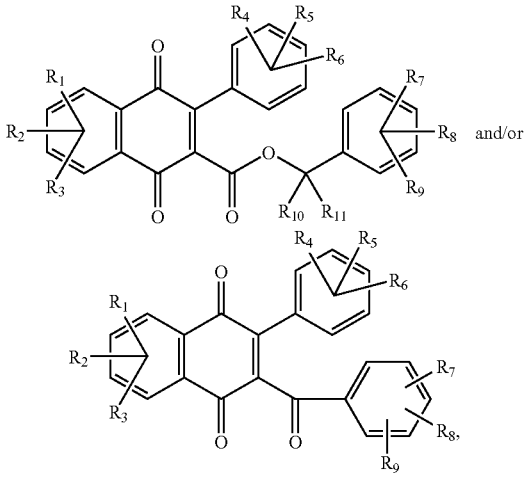

wherein each R is independently selected from the group consisting of hydrogen, alkyl with 1 to about 40 carbon atoms, alkoxy with 1 to about 40 carbon atoms, phenyl, substituted phenyl, higher aromatics, such as naphthalene and anthracene, alkylphenyl with about 6 to about 40 carbons, alkoxyphenyl with about 6 to about 40 carbons, aryl with about 6 to about 30 carbons, substituted aryl with about 6 to about 30 carbons and halogen; a diphenoquinone represented by the following

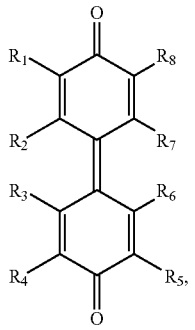

and mixtures thereof, wherein each of the R substituents are as illustrated herein; or oligomeric and polymeric derivatives in which the above moieties represent part of the oligomer or polymer repeat units, and mixtures thereof wherein the mixtures can contain from 1 to about 99 weight percent of one electron transport component and from about 99 to about 1 weight percent of a second electron transport component, and which electron transports can be dispersed in a resin binder, and wherein the total thereof is about 100 percent.

Examples of the hole blocking layer component selected, for example, in an amount of from about 0.1 to about 99.9 weight percent, and more specifically, from about 10 to about 80 weight percent, and yet more specifically, from about 30 to about 60 weight percent, include the copolymers and polymers illustrated herein, such as copolymers of aminopropyltrialkoxysilane, and more specifically, copolymers of 3-aminopropyltrialkoxysilane (g-APS), and 3-aminopropylmethyl diethoxysilane (2-APS); copolymers of 3-aminopropyltrialkoxysilane (g-APS) and a dialkoxy silane, such as a diethoxydimethylsilane, copolymers of g-APS and a silane, such as a mono, di, tri, or tetra alkoxy silane, such as trimethylalkoxysilane, dimethyldialkoxysilane, methyltriakoxysilane and trialkoxysilane, such as tetraethylorthosilicate, and copolymers of an aminoalkylalkoxysilane wherein alkyl contains, for example, from about 1 to about 12 carbon atoms, alkoxy contains, for example, from about 1 to about 12 carbon atoms, and more specifically, wherein alkoxy is a trialkoxy, such as an aminoalkyltrialkoxysilane; copolymers of g-APS and 2-APS; copolymers of g-APS, 2-APS and a dialkoxydialkylsilane like diethoxydimethylsilane or a trialkoxysilane like methyltriethoxysilane; and wherein the ratio amounts of each monomer component of g-APS, and the alkylalkoxysilane is, for example, from about −0.1/0.99 to about −0.99/0.01, and more specifically, from about −0.2/0.8 to about 0.5/0.5.

The silanes can be purchased from many commercial sources such as Aldrich Chemical Company (Milwaukee Wis.), Genesse Polymer Corp. (Flint, Mich.) and OSi Specialty (Crompton Corporation) (South Charleston, W. Va.).

A typical silane copolymer coating solution can be generated as follows: 10 grams of a 1:1 molar ratio mixture of g-APS and 2-APS premixed well were placed in 10 grams of water and orbital shaken for 4 hours, then 3 grams of acetic acid were added and the sample orbital shaken for a further 1.5 hours. This solution can be let down to a suitable viscosity for coating with an alcoholic solvent, such as methanol, ethanol, propanol, butanol and the like, or mixtures of alcoholic solvents and hydrocarbon solvents such as hexane, heptane, toluene and the like.

The hole blocking layer can in embodiments be prepared by a number of known methods; the process parameters being dependent, for example, on the member desired. The hole blocking layer can be coated as solutions or dispersions onto a selective substrate by the use of a spray coater, dip coater, extrusion coater, roller coater, wire-bar coater, slot coater, doctor blade coater, gravure coater, and the like, and dried at from about 40° C. to about 200° C. for a suitable period of time, such as from about 10 minutes to about 10 hours under stationary conditions or in an air flow. The coating can be accomplished to provide a final coating thickness of from about 1 to about 15 microns after drying.

Illustrative examples of substrate layers selected for the imaging members of the present invention include a number of known substrates, and especially those substrates that enable support for the layers thereover and cause minimal adverse affects to the operation of the members. The substrate can be opaque, substantially transparent, and the like, and may comprise any suitable material having the requisite mechanical properties. Thus, the substrate may comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example a plate, a cylindrical drum, a scroll, an endless flexible belt, and the like. In one embodiment, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®. Moreover, the substrate may contain thereover an undercoat layer, including known undercoat layers, such as suitable phenolic resins, phenolic compounds, mixtures of phenolic resins and phenolic compounds, titanium oxide, silicon oxide mixtures like $TiO_2/SiO_2$, the components of copending application U.S. Ser. No. 10/144,147, filed May 10, 2002, the disclosure of which is totally incorporated herein by reference, and the like.

The thickness of the substrate layer depends on many factors, including economical considerations, thus this layer may be of substantial thickness, for example over 3,000 microns, or of minimum thickness providing there are no significant adverse effects on the member. In embodiments, the thickness of this layer is from about 75 microns to about 300 microns.

The photogenerating layer, which can be comprised of the components indicated herein, such as hydroxychlorogallium phthalocyanine, is in embodiments comprised of, for example, about 50 weight percent of the hyroxygallium or other suitable photogenerating pigment, and about 50 weight percent of a resin binder like polystyrene/polyvinylpyridine. The photogenerating layer can contain known photogenerating pigments, such as metal phthalocyanines, metal free phthalocyanines, hydroxygallium phthalocyanines, perylenes, especially bis(benzimidazo)perylene, titanyl phthalocyanines, and the like, and more specifically, vanadyl phthalocyanines, Type V chlorohydroxygallium phthalocyanines, and inorganic components, such as selenium, especially trigonal selenium. The photogenerating pigment can be dispersed in a resin binder similar to the resin binders selected for the charge transport layer, or alternatively no resin binder is needed. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 15 microns, and more specifically, from about 1 micron to about 4 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenoxy resins, polyurethanes, poly(vinyl alcohol), polyacrylonitrile, polystyrene, and the like. It is desirable to select a coating solvent that does not substantially disturb or adversely effect the other previously coated layers of the device. Examples of solvents that can be selected for use as coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layers in embodiments of the present invention can be accomplished with spray, dip or wire-bar methods such that the final dry thickness of the photogenerator layer is, for example, from about 0.01 to about 30 microns, and more specifically, from about 0.1 to about 15 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the effective amount of polymer binder that is utilized in the photogenerator layer ranges from about 0 to about 95 percent by weight, and preferably from about 25 to about 60 percent by weight of the photogenerator layer.

As optional adhesive layers usually in contact with the hole blocking layer, and situated between the hole blocking layer and the photogenerating layer, there can be selected various known substances inclusive of polyesters, polyamides, poly(vinyl butyral), poly(vinyl alcohol), polyurethane and polyacrylonitrile. This layer is, for example, of a thickness of from about 0.001 micron to about 3 microns, and more specifically, about 0.1 to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present invention further desirable electrical and optical properties.

Various suitable know charge transport compounds, molecules and the like can be selected for the charge transport layer, such as aryl amines of the following formula

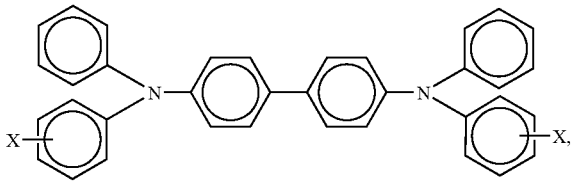

and wherein the thickness thereof is, for example, from about 5 microns to about 75 microns, and from about 10 microns to about 40 microns dispersed in a polymer binder, wherein X is an alkyl group, a halogen, or mixtures thereof, especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

Examples of binder materials for the transport layers include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes and epoxies, and block, random or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the transport layer contains from about 10 to about 75 percent by weight of the charge transport material, and preferably from about 35 percent to about 50 percent of this material.

Also, included within the scope of the present invention are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The following Examples are being submitted to illustrate embodiments of the present invention. These Examples are intended to be illustrative only and are not intended to limit the scope of the present invention. Also, parts and percentages are by weight unless otherwise indicated. Comparative Examples and data are also provided.

EXAMPLE I

5 Grams of 3-aminopropyltriethoxysilane (g-APS) were rapidly added to 5 grams of distilled and deionized water in a 30 milliliter amber bottle and the mixture shaken on an orbital shaker for 3 hours. 1.5 Grams of glacial acetic acid were then added and the mixture resulting was shaken for an additional 3 hours. Dilution of the resulting solution with 68.5 grams of absolute ethanol provided a solution suitable for coating as indicated in Example IV that follows.

EXAMPLE II

1 Gram of 3-aminopropyltriethoxysilane (g-APS) and 4 grams of 3-aminopropylmethyldiethoxysilane (2-APS) were premixed and then added to 5 grams of water in a 30 milliliter amber bottle and shaken on an orbital shaker for 3 hours. 1.35 Grams of glacial acetic acid were then added and the resulting mixture was shaken for an additional 3 hours. Dilution of this solution with 68.5 grams of absolute ethanol provided a solution suitable for coating as illustrated in Example IV that follows.

EXAMPLE III 2.5 Grams of 3-aminopropyltriethoxysilane (g-APS) and 2.5 grams of diethoxyldimethylsilane (DEDMS) were premixed and then added to 5 grams of water in a 30 milliliter amber bottle and shaken on an orbital shaker for 3 hours. 0.75 Gram of glacial acetic acid was added and the mixture was shaken for an additional 3 hours. Dilution of this solution with 68.5 grams of absolute ethanol provided a solution suitable for coating as illustrated in Example IV that follows.

EXAMPLE IV

Device Fabrication:

For the evaluation of the silane hole blocking properties, photoreceptor, were fabricated by coating the silane, charge generator, and charge transport layers respectively, onto a conductive substrate. The photoreceptors prepared had common charge generator and a common charge transport layers but varied in the silane layer. The silane solutions were prepared according to Examples I to III. The mill base for the charge generator dispersion was prepared by roll milling 2.4 grams of Type V hydroxygallium phthalocyanine (HOGaPc) pigment, 0.45 gram of the polycarbonate (PCZ 200, Mitsubishi Gas Company), 44.7 grams of tetrahydrofuran and 60 c.c. of ⅛ inch stainless steel balls in a 120 milliliter bottle for 24 hours. The final generator dispersion was obtained by mixing 10 grams of a millbase with a solution of 0.47 gram of PCZ 200 and 7.42 grams of THF in a 30 milliliter bottle on a paint shaker for 10 minutes. The charge transport solution was prepared by mixing 6 graams of N,N'-diphenyl-N,N'-bis(3-methylphenyl) 1,1'-biphenyl-4,4'-diamine, 6 grams of polycarbonate resin (MAKROLON®, Bayer Company), and 73.8 grams of methylene dichloride in a 120 milliliter bottle using a magnetic stirrer for about 5 hours.

The silane solution was coated onto a Ti—Zr metallized MYLAR® sheet using a 0.25 mil Bird applicator. The silane layer was dried in a forced air oven at 120° C. for 1.5 minutes. The above HOGaPc/PCZ generator dispersion was then coated onto the silane layer to form a charge generator layer using a 0.25 mil Bird applicator. The devices were dried at 120° C. for 1.5 minutes; the resulting layer was about 0.5 micron thick. The generator layer was then overcoated with the above charge transport solution using a 3 mil Bird applicator. The device was dried again at 120° C. for 1.5 minutes; the charge transport layer resulting was about 15 microns thick.

Photoreceptors were fabricated per the above having different silane charge blocking layers.

| DEVICE NUMBER | SILANE LAYER |
|---|---|
| B1 | γ-APS (EXAMPLE I) |
| B2 | 20:80 γAPS-2APS (EXAMPLE II) |
| B3 | 50:50 γAPS:DEDMS (EXAMPLE III) |

EXAMPLE V

The photoconductive devices then were evaluated for CDS density on the CDS scanner by the following procedure. The devices were first wrapped completely around a 5 inch diameter Ti—Zr, referenced above, conductive drum and secured with adhesive tape. Copper tape was used to ground the substrate to the drum, and the drum rotated at 60 rpm. The devices were charged using a dual array pin scorotron employing a pin current of −379 μA and a grid voltage of −550V. The CDS density was measured at 333 ms after charging by the CDS probe. The devices were erased with a light bar at 666 ms.

Aerodynamic floating was used to control the separation distance between the CDS probe and the devices. The probe diameter was 140 μm and the probe sample distance was approximately 90 μm. The CDS probe was biased to the surface potential of the device to prevent dielectric breakdown. A synchronous 50 $V_{pp}$ square wave was applied to the drum at half the data acquisition frequency to correct for small irregularities in the separation distance.

The CDS probe scanned the devices along a length of 2.4 centimeters along the slow axis of the drum and 12 centimeters along the fast axis. The step resolution was 40 μm along the slow axis and 37 μm along the fast axis. The measurement process was controlled by a PC based data acquisition system. Image analysis software was used to post-process the data and to determine the CDS density in the area measured, resulting in excellent CDS as illustrated herein for embodiments of the invention devices, and more specifically, CDS reductions as compared to similar devices that contained only γ-APS rather than the compolymers recited herein, and in embodiments substantial elimination of CDS.

Using Si NMR spectroscopy it had been determined that when g-APS was dissolved in water a rapid sequence of hydrolysis and condensation occurred to form a siloxane network comprising approximately 3 parts PSS/POSS and 1 part PS on neutralization with acetic acid when n:m=3:1, o, p and q=0, and $R_1$=ethyl.

The formation of the siloxane network was rapid and equilibrium occurred in under 30 miunutes. The dissolution of γ-APS in water produced a significant amount of heat. The addition of a stoichiometric amount of acetic acid, so as to neutralize the amino groups of the γ-APS, resulted in changes in the $^{29}$Si NMR spectrum, for example several of the distinct resonance become more prevalent between δ=−64 and −72 ppm; there is a portion of dimeric species produced (δ=−50 pmm—−52 ppm) and a trace of trisilanol can be detected (δ=−41 ppm). The changes in the spectrum were indicative of the establishment of a new equilibrium under the now neutral conditions different from the equilibrium obtained under basic conditions. It would appear by the sharpening of the resonances between −64 pmm and −72 pmm, the formation of dimeric materials, and the appearance of trisilanol that the formation of more discrete species should form under neutral conditions.

The high amounts of PSS and POSS component found in the polysiloxane network formed when g-APS were hydrolysis/condensed in water indicated that these materials were highly crosslinked (high PSS/POSS:PS ratio) and to some extent crystalline (the POSS of γ-APS is a known white crystalline material). Furthermore, the relatively high salt content formed with the addition of acetic acid (i.e. R—$NH_3$+Ac-) rendered these materials highly ionic. This would lead one to believe that these materials may be difficult to coat onto a substrate in a uniform manner with reasonable mechanical integrity. On a molecular scale, incorporation of linear segments into the polysiloxane network would allow for a more flexible network or at the least some measure of flexibility in an otherwise highly crosslinked material. Furthermore, addition of other hydrocarbon (and hence hydrophobic) moieties may lead to a reduction in any humidity sensitivity these materials may possess due to their ionic nature. Also, the incorporation of dialkoxysilanes into the polysiloxane network will introduce linear segments into the network and as a result lower the PSS/POSS:PS ratio. Mixtures of dialkoxysilanes and g-APS underwent hydrolysis and condensation in water or water alcoholic mixtures to form a siloxane copolymer species with g-APS. The formation of copolymers can directly influence both the PSS/POSS:PS ratio and the ionic nature of the polysiloxane network. Using $^{29}$Si NMR spectroscopy, when an equal molar mixture of g-APS and 3-aminopropylmethyldiethoxysilane was dissolved in water and neutralized with acetic acid to form a copolysiloxane network comprised of approximately 1 part PSS/POSS and 1 part PS, on neutralization with acetic acid ((n+o):m=3:1, p and q=0, $R_1$=ethyl, $R_2$=methyl and $R_3$=3-(ammonium actetate)-propyl).

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A photoconductive imaging member comprised of an optional supporting substrate, a hole blocking layer thereover, a photogenerating layer, and a charge transport layer, and wherein the hole blocking layer is comprised of at least one copolymer of an aminoalkyltrialkoxysilane and a silane, wherein said silane is a monoalkoxy, a dialkoxy, a trialkoxy, or a tetralkoxy silane.

2. A member in accordance with claim 1 wherein said alkyl contains from 1 to about 18 carbon atoms.

3. A member in accordance with claim 1 wherein said alkyl contains from 1 to about 10 carbon atoms.

4. A member in accordance with claim 1 wherein said alkyl is propyl.

5. A member in accordance with claim 1 wherein said alkoxy contains from 1 to about 12 carbon atoms.

6. A member in accordance with claim 1 wherein said alkoxy is ethoxy, propoxy, butoxy, or pentoxy.

7. A member in accordance with claim 1 wherein said aminoalkyltrialkoxysilane is 3-aminopropyltrialkoxysilane.

8. A photoconductive imaging member comprised of a supporting substrate, a hole blocking layer thereover, a photogenerating layer, and a charge transport layer, and wherein the hole blocking layer is comprised of at least one copolymer of an aminoalkyltrialkoxysilane, and an aminodialkyldialkoxysilane, and wherein said aminoalkyltrialkoxysilane is a 3-aminopropyltrialkoxysilane, and said aminodialkyl dialkoxysilane is 3-aminopropylmethyldiethoxysilane.

9. A photoconductive imaging member comprised of an optional supporting substrate, a hole blocking layer thereover, a photogenerating layer, and a charge transport layer, and wherein the hole blocking layer is comprised of a copolymer of an aminoalkyltrialkoxysilane, and a dialkoxydialkylsilane, and wherein said aminoalkyltrialkoxysilane is a 3-aminopropyltrialkoxysilane, and said dialkoxy dialkylsilane is diethoxydimethylsilane.

10. A member in accordance with claim 9 wherein said aminoalkyltrialkoxysilane is 3-aminopropyltrialkoxysilane and said dialkoxy dialkylsilane is diethoxydimethylsilane.

11. An imaging member in accordance with claim 1 further containing an electron transport layer of N,N'-bis(1,2-dimethylpropyl)-1,4,5,8-naphthalenetetracarboxylic acid; bis(2-heptylimido)perinone; BCFM, butoxy carbonyl fluorenylidene malononitrile; benzophenone bisimide; or a substituted carboxybenzylnaphthaquinone.

12. An imaging member in accordance with claim 1 wherein said hole blocking layer is of a thickness of from about 2 to about 12 microns.

13. An imaging member in accordance with claim 12 further containing an electron transport layer of (4-n-butoxycarbonyl-9-fluorenylidene) malononitrile (BCFM), 2-methylthioethyl 9-dicyanomethylenefluorene-4-carboxylate, 2-(3-thienyl)ethyl 9-dicyanomethylenefluorene-4-carboxylate, 2-phenylthioethyl 9-dicyanomethylenefluorene-4-carboxylate, 11,11,12,12-tetracyano anthraquino dimethane or 1,3-dimethyl-10-(dicyanomethylene)-anthrone.

14. An imaging member in accordance with claim 1 comprised in the following sequence of said supporting substrate, said hole blocking layer, an adhesive layer, said photogenerating layer, and said charge transport layer, and wherein said charge transport layer is a hole transport layer.

15. An imaging member in accordance with claim 14 wherein the adhesive layer is comprised of a polyester with an $M_w$ of from about 45,000 to about 75,000, and an $M_n$ of from about 25,000 to about 40,000.

16. An imaging member in accordance with claim 1 wherein the supporting substrate is comprised of a conductive metal substrate, and optionally which substrate is aluminum, aluminized polyethylene terephthalate, or titanized polyethylene terephthalate.

17. An imaging member in accordance with claim 1 wherein said photogenerator layer is of a thickness of from about 0.05 to about 10 microns, and wherein said transport layer is of a thickness of from about 10 to about 50 microns.

18. An imaging member in accordance with claim 1 wherein the photogenerating layer is comprised of photogenerating pigments dispersed in a resinous binder, which pigments are selected in an optional amount of from about 5 percent by weight to about 95 percent by weight, and optionally wherein the resinous binder is selected from the group consisting of polyesters, polyvinyl butyrals, polycarbonates, polystyrene-b-polyvinyl pyridine, and polyvinyl formals.

19. An imaging member in accordance with claim 1 wherein the charge transport layer comprises aryl amines, and which aryl amines are of the formula

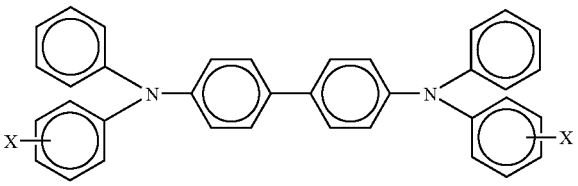

wherein X is selected from the group consisting of alkyl and halogen.

20. An imaging member in accordance with claim 19 wherein alkyl contains from about 1 to about 10 carbon atoms, wherein alkyl contains from about 1 to about 5 carbon atoms in said layer wherein halogen is chlorine, and wherein there is further included a resinous binder selected from the group consisting of polycarbonates and polystyrenes.

21. An imaging member in accordance with claim 19 wherein the aryl amine is N,N'-diphenyl-N,N-bis(3-methyl phenyl)-1,1'-biphenyl-4,4'-diamine.

22. An imaging member in accordance with claim 1 wherein the photogenerating layer is comprised of metal phthalocyanines, hydroxygallium phthalocyanines, chlorogallium phthalocyanines, or metal free phthalocyanines.

23. An imaging member in accordance with claim 1 wherein the photogenerating layer is comprised of titanyl phthalocyanines, perylenes, or halogallium phthalocyanines.

24. A method of imaging which comprises generating an electrostatic latent image on the imaging member of claim 1, developing the latent image, and transferring the developed electrostatic image to a suitable substrate.

25. An imaging member in accordance with claim 1 wherein said hole blocking layer is of a thickness of about 2 to about 4 microns.

26. An imaging member in accordance with claim 1 wherein said at least one is one.

27. An imaging member in accordance with claim 1 wherein said at least one is from about 2 to about 10.

28. A photoconductive imaging member comprised of an optional supporting substrate, a hole blocking layer thereover, a photogenerating layer, and a charge transport layer, and wherein the hole blocking layer is comprised of at least one copolymer of an aminoalkyltrialkoxysilane and a silane, and wherein said copolymer is of the formula

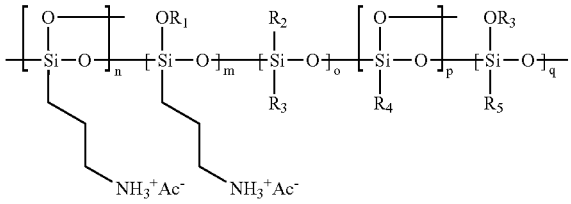

wherein n, m, o, p and q represent the number or mole percent of each segment, and each R is selected from the group consisting of alkyl and aryl.

* * * * *